US008123879B1

(12) United States Patent
Bellitto et al.

(10) Patent No.: US 8,123,879 B1
(45) Date of Patent: Feb. 28, 2012

(54) ENERGETIC COMPOSITION OF ADJACENT LAYERS OF AN EXPLOSIVE AND A COMBUSTIBLE FUEL AND MAKING OF SAME

(75) Inventors: Victor J. Bellitto, Alexandria, VA (US); Stanley M. Caulder, Alexandria, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 1128 days.

(21) Appl. No.: 11/900,134

(22) Filed: Sep. 6, 2007

(51) Int. Cl.

| | |
|---|---|
| ***C06B 45/00*** | (2006.01) |
| ***C06B 45/16*** | (2006.01) |
| ***C06B 31/00*** | (2006.01) |
| ***C06B 29/00*** | (2006.01) |
| ***D03D 23/00*** | (2006.01) |
| ***D03D 43/00*** | (2006.01) |

(52) U.S. Cl. ..... 149/16; 149/2; 149/45; 149/75; 149/108.2; 149/109.2; 149/109.4

(58) Field of Classification Search ..... 149/16, 149/2, 45, 75, 108.2, 109.2
See application file for complete search history.

(56) References Cited

U.S. PATENT DOCUMENTS

| | | | | |
|---|---|---|---|---|
| 3,056,701 | A * | 10/1962 | Fritzlen | 102/202 |
| 4,106,410 | A * | 8/1978 | Borcher et al. | 102/495 |
| 5,024,159 | A * | 6/1991 | Walley | 102/289 |
| 6,896,059 | B2 * | 5/2005 | Brooks et al. | 166/297 |

OTHER PUBLICATIONS

Bellitto, Victor J., High Explosive and Metal Composites, 38th International Annual Conference of ICT, Jun. 26-29, 2007.

* cited by examiner

*Primary Examiner* — James McDonough
(74) *Attorney, Agent, or Firm* — Fredric J. Zimmerman

(57) ABSTRACT

The invention generally relates to an energetic composition including adjacent layers of an explosive and a combustible fuel, and making of the energetic composition. Specifically, making the energetic composition includes vapor deposition of an explosive layer on a combustible fuel surface; alternatively, a combustible fuel layer may be chemically or physically deposited on an explosive surface to make the energetic composition.

16 Claims, 2 Drawing Sheets

ENERGETIC COMPOSITION OF ADJACENT LAYERS OF AN EXPLOSIVE AND A COMBUSTIBLE FUEL AND MAKING OF SAME

STATEMENT OF GOVERNMENT INTERESTS

The invention described herein may be manufactured and used for the Government of the United States of America for governmental purposes without payment of any royalties thereon or therefore.

FIELD OF THE INVENTION

The present invention generally relates to an energetic composition that may include adjacent layers of an explosive and a combustible fuel, and making of the energetic composition. Specifically, a layer of explosive may be deposited on a combustible fuel surface; alternatively, a combustible fuel layer may be deposited on a surface of an explosive layer to make the energetic composition. More specifically, multiple layers of alternating explosive and combustible fuel layers may comprise the energetic composition.

BACKGROUND OF THE INVENTION

"Energetic" compositions may be used in a wide variety of applications, e.g., propellants, initiating materials, gas generators, and explosives. Formulations of energetic compositions may include one or more of the following: explosives, combustible fuels, plasticizers, binders, oxidizers, desensitizers, etc. Typically, conventional formulations of energetic compositions may then be mixed, cast, pressed, and sometimes dried.

One of the primary goals in developing new energetic compositions is to increase the energy output. After mixing, in the conventional formulation, a particle of an explosive within the resultant mix may be separated from, for example, a particle of combustible fuel, by intervening particles of binder or plasticizer. This separation of explosive from its fuel may decrease the energy output of the energetic composition, when compared to an energetic composition in which an explosive is adjacent to its fuel.

An energetic composition may benefit greatly in increased energy output, if an explosive is always adjacent to its fuel. The enhanced proximity of the explosive to its fuel may result in more complete consumption of the fuel, providing increased energy output. Such an increased energy output may translate into significant weight reductions for an energetic composition used, for example, as a payload or propellant.

The energetic compound may also benefit from the absence of the formulating overhead of mixing, casting, pressing, and drying, if the enhanced proximity of the explosive to its fuel is accomplished by a vapor or physical deposition method, similar to that used in electronic microchip fabrication.

Currently, there is no known report of formulating an energetic composition by a vapor or physical deposition method that places an explosive adjacent to its fuel.

SUMMARY OF THE INVENTION

In addition to increasing the energy output of an energetic composition in which an explosive and its fuel may be deposited adjacent to one another, recent understanding of the process, by which initiation occurs in crystalline or polycrystalline explosives that are subject to shear-induced plastic flow from shock or impact, provides additional benefits from deposition methods in the making of the energetic composition. Plastic flow in crystals is due to the creation and motion of dislocations; these dislocations distort the explosive molecules and this distortion and dislocated motion introduces micro-shear bands. These micro-shear bands are sites of heating, melting, sudden crystal failure, and chemical reaction initiation.

It is expected that deposition of a combustible fuel layer, adjacent to a crystalline or polycrystalline explosive layer, would provide: structural protection that may prevent accidental initiation from shock or impact by minimizing plastic flow of the crystal; heat dissipation that prevents initiation by hot spots caused by micro-shear bands; and when the combustible fuel is a metal or metal alloy, electrostatic discharge protection by neutralizing the electrical charge of the crystalline explosive.

It is further expected that precise control of the thickness of the deposited layers of explosive and fuel by vapor or physical deposition methods will allow optimization of energetic output for specific shapes and sizes of the energetic composition, when used as either propellant or payload.

An aspect of an exemplary embodiment of the present invention includes an energetic composition comprising a first layer of a combustible fuel and a second layer of an explosive deposited on the first layer of the combustible fuel.

Another aspect of an exemplary embodiment of the present invention includes an energetic composition comprising a first layer of an explosive and a second layer of a combustible fuel deposited on the first layer of the explosive.

Yet another aspect of an exemplary embodiment of the present invention includes an energetic composition comprising a first layer of a combustible fuel, a second layer of an explosive deposited on the first layer of the combustible fuel, and a third layer of the combustible fuel deposited on the second layer of the explosive.

Yet another aspect of an exemplary embodiment of the present invention includes an energetic composition comprising a first layer of an explosive, a second layer of a combustible fuel deposited on the first layer of the explosive, and a third layer of the explosive deposited on the second layer of the combustible fuel.

Yet another aspect of an exemplary embodiment of the present invention includes a method of making an energetic composition comprising vapor deposition of an explosive onto a surface of a combustible fuel in a controlled atmosphere, wherein the controlled atmosphere comprises one of an ultra high vacuum, a high vacuum, a medium vacuum, a low vacuum, an inert atmosphere, and a combination of a vacuum and inert gases.

Yet another aspect of an exemplary embodiment of the present invention includes a method of making an energetic composition comprising chemical or physical deposition of a combustible fuel onto a surface of an explosive in a controlled atmosphere, wherein the controlled atmosphere comprises one of an ultra high vacuum, a high vacuum, a medium vacuum, a low vacuum, an inert atmosphere, and a combination of a vacuum and inert gases.

BRIEF DESCRIPTION OF THE DRAWINGS

Exemplary embodiments of the present invention are discussed hereinafter in reference to the drawings, in which.

DETAILED DESCRIPTION OF EXEMPLARY EMBODIMENTS OF THE INVENTION

Figure 1:
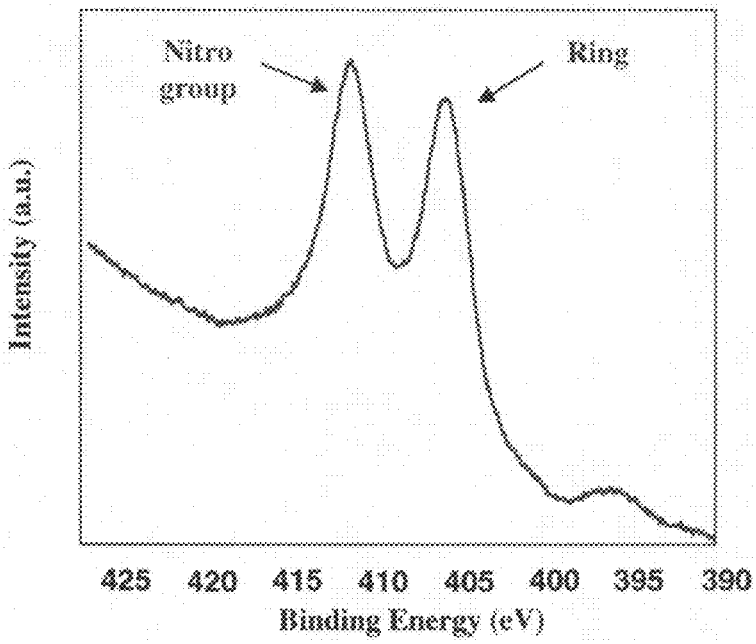
FIG. 1 illustrates a representative experimental spectrum obtained from X-ray photoelectron spectroscopy (XPS) of vapor deposited RDX, which is identical to inserted samples of RDX, in the experimental apparatus in an exemplary embodiment of the present invention.

An exemplary embodiment of the present invention may include deposition of a precisely controlled thickness of an explosive layer on a surface of a combustible fuel. The explosive may comprise nitramines, sometimes referred to as nitroamines, for example, 1,3,5-trinitro-1,3,5-triazinane (RDX), 1,3,5,7-tetranitroperhydro-1,3,5,7-tetrazocine (HMX), 2,4,6,8,10,12-hexanitro-2,4,6,8,10,12-hexaazaisowurtzitane (CL-20), and other energetic compounds, for example, 2-methyl-1,3,5-trinitrobenzene (TNT), 2,4,6-trinitrophenyl-N-methlynitramine (Tetryl), 1,3,5-trinitro-2-[2-(2,4,6-trinitrophenyl)ethenyl]benzene (HNS), 3-nitro-1,2,4-triazol-5-one (NTO), 1,3,3-trinitroazetidine (TNAZ), nitroguanidine (NQ), 1,3-dinnitrato-2,2-bis(nitratomethyl) propane (PETN), ammonium dinitramide (AND), 1,3,5-triamino-2,4,6-trinitrobenzene (TATB), ammonium nitrate, and ammonium perchlorate, while the combustible fuel may comprise a metal or metal alloy including at least one of aluminum, copper, iron, tungsten, hafnium, tantalum, magnesium, nickel, sodium, molybdenum, and potassium, or a non-metal, for example, at least one of phosphorous and boron.

The deposition method may include, for example, chemical vapor deposition. The vapor deposition method may utilize: an ultra high vacuum (less than about $10^{-9}$ Torr); a high vacuum (from about $10^{-6}$ to about $10^{-8}$ Torr); a medium vacuum (from about $10^{-3}$ to about $10^{-5}$ Torr); a low vacuum (from about 1 to about $10^{-3}$ Torr); an inert atmosphere, including, for example, at least one of argon, helium, and nitrogen; or a combination of a moderate vacuum with an inert atmosphere. The thickness of the vapor deposited layer of explosive may be controlled to about plus or minus 0.1 nm and may range from less than about 0.1 nm to about 100 μm.

Experimental Results: Vapor Deposition of RDX on Aluminum

The vapor deposition of the explosive, RDX, onto a combustible metal surface of aluminum was accomplished in an ultra high vacuum (UHV) apparatus.

The experiments were performed in a stainless steel UHV chamber with a working base pressure of $1\times10^{-10}$ Torr. The UHV chamber contained, among other things, a hemispherical analyzer used in concert with a dual Al/Mg $K_\alpha$ X-ray source for X-ray photoelectron spectroscopy (XPS), a quadrupole mass spectrometer for residual gas analysis, a calibrated directed-flux doser, and two ZnSe windows to transmit light for infrared reflection-absorption spectroscopy (IRRAS). Vapor deposition thickness of the RDX was monitored with a quartz crystal microbalance and ranged from about a few nm to about 1000 nm.

The RDX vapor was introduced into the UHV chamber by differential pumping from a glass bulb containing RDX. The glass bulb was attached to the UHV chamber via a glass-to-metal seal. Regulation of the introduction of the RDX vapor was accomplished by use of an all-metal Nupro valve and by heating of the glass bulb with an oil bath up to approximately 120° Celsius. Vapor deposition of the RDX in the ultra high vacuum environment prevented contamination of the energetic composition by $H_2O$, $O_2$, etc.

FIG. 1 shows a representative experimental spectrum obtained from X-ray photoelectron spectroscopy (XPS) of vapor deposited RDX, which was identical to inserted samples of RDX, in the experimental apparatus, described above The spectrum shown is of the N 1s region and has two clearly discernable peaks. One of the peaks is attributed to the signal intensity emitted from the nitrogen of the nitro-group and the other from the nitrogen of the ring structure of RDX. The spectrum demonstrates how XPS may identify changes to the chemical state of RDX, as exemplified by the N 1s region, and also its capability in elemental analysis.

X-ray photoelectron spectroscopy was invaluable in monitoring of surface modifications of RDX during deposition because of its ability to sample surface depths of less than about 3 nm.

Experimental Results: Vapor Deposition of Aluminum on RDX

Another aspect of an exemplary embodiment of the present invention may include vapor deposition, or physical deposition, that is, sputtering, of a combustible fuel layer, for example, aluminum, onto a surface of a single crystal, crystals or polycrystalline layer of an explosive, for example, 1,3,5-trinitro-1,3,5-triazinane (RDX). The deposition method may utilize: an ultra high vacuum (less than about $10^{-9}$ Torr); a high vacuum (from about $10^{-6}$ to about $10^{-8}$ Torr); a medium vacuum (from about $10^{-3}$ to about $10^{-5}$ Torr); a low vacuum (from about 1 to about $10^{-3}$ Torr); an inert atmosphere, including, for example, at least one of argon, helium, and nitrogen; or a combination of a vacuum with an inert atmosphere. The thickness of the deposited layer of combustible fuel may range from less than about 0.1 nm to about 100 μm.

The vapor deposition of the combustible fuel, aluminum, onto an explosive surface of RDX was accomplished in an ultra high vacuum (UHV) apparatus.

The experiments were performed in a stainless steel UHV chamber with a working base pressure of $1\times10^{-10}$ Torr. The UHV chamber contained, among other things, a hemispherical analyzer used in concert with a dual Al/Mg $K_a$ X-ray source for X-ray photoelectron spectroscopy (XPS), a quadrupole mass spectrometer for residual gas analysis, an ion sputter gun, a calibrated directed-flux doser, an aluminum vapor doser and two ZnSe windows to transmit light for infrared reflection-absorption spectroscopy (IRRAS). Vapor deposition thickness of the aluminum layers was monitored with a quartz crystal microbalance and ranged from about 1 to about 0.10 nm.

The combustible metal vapor deposition was performed by heating an aluminum wire encapsulated within an alumina tube. The alumina tube was heated by applying electrical current through a tungsten filament wrapped around the tube. The aluminum vapor deposition was performed in-situ to minimize environmental contamination by $H_2O$, $O_2$, etc., and thus, prevented the deleterious formation of aluminum oxide.

The RDX samples were mounted onto a grounded translation stage with double-sided conductive tape to minimize electrical charging.

Figure 2:
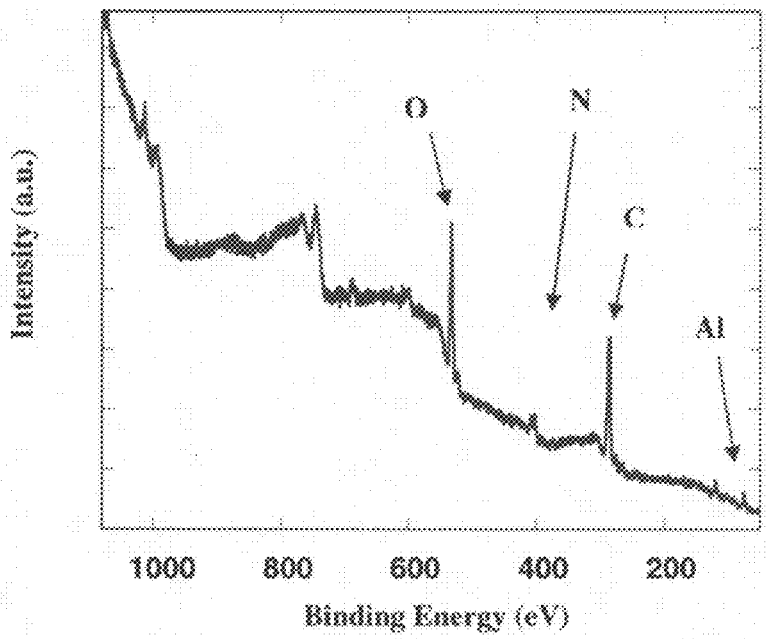
FIG. 2 illustrates a wide-scan spectrum of RDX following aluminum deposition of less than about 1 nm for the C 1s, N 1s, O 1s regions of RDX, as well as the aluminum regions, in an exemplary embodiment of the present invention.

FIG. 2 shows a wide-scan spectrum of RDX following aluminum deposition of less than about 1 nm. In the spectrum are visible the C 1s, N 1s, O 1s regions as well as the aluminum regions. This wide-scan spectrum illustrates the ability of X-ray photoelectron spectroscopy to monitor deposition of the aluminum and to study the interface between the RDX and aluminum layers as the aluminum layer is increased in thickness.

Figure 3:
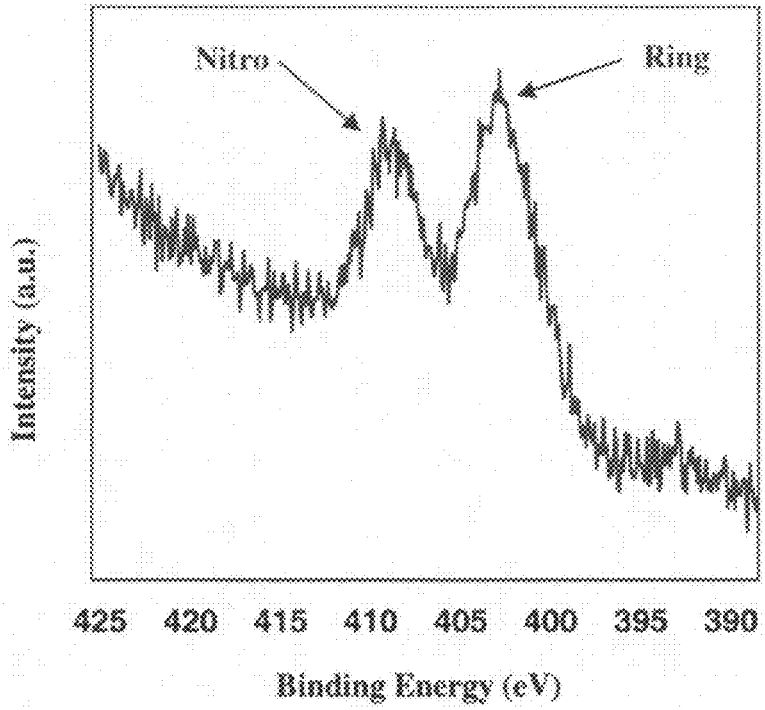
FIG. 3 illustrates the N is spectrum of the RDX particles following deposition of less than about 1 nm of aluminum in an exemplary embodiment of the present invention.

FIG. 3 shows the N is spectrum of the RDX particles following deposition of less than about 1 nm of aluminum. This N 1s spectrum reveals that the nitrogen peak associated with the nitro group is diminished compared to that of the ring structure. This is an indication of the preferential reaction of the nitro group of RDX to the initial aluminum deposition leaving the ring structure intact. With increasing exposure to aluminum vapor the signal associated with the nitro group is diminished further with little change observed in the N 1s intensity of the ring structure.

Figure 4:
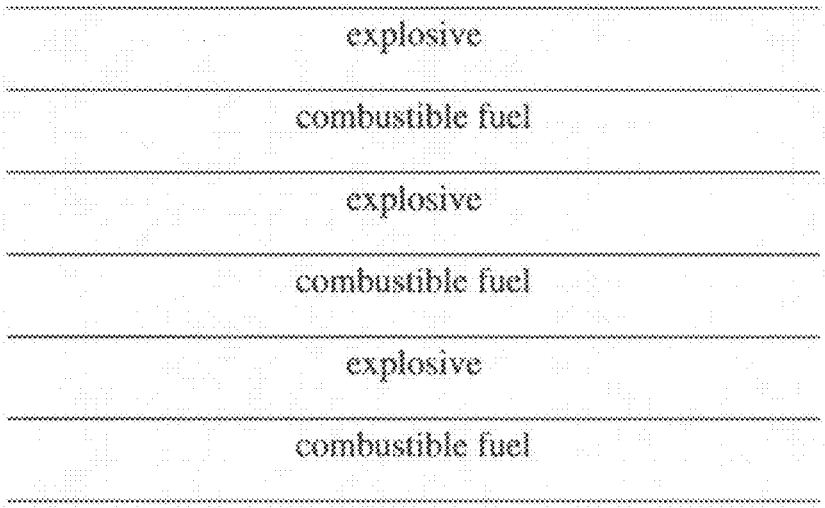
FIG. 4 illustrates multiple alternating layers of combustible fuel and explosive, forming an energetic composition, in which a combustible fuel layer may be sandwiched between two explosive layers, while an explosive layer may be sandwiched between two combustible fuel layers in an exemplary embodiment of the present invention.

FIG. 4, shows yet another aspect of an exemplary embodiment of the invention that may include multiple alternating layers of combustible fuel and an explosive to form an energetic composition. In such an energetic composition, a combustible fuel layer may be sandwiched between two explosive layers, while an explosive layer is sandwiched between two combustible fuel layers. Such an alternating layer composition would essentially encapsulate most of the explosive layers with fuel layers. When the combustible fuel layers comprise a metal or metal alloy, the explosive layers would be electrically neutralized from static charges; whereas the inner combustible fuel layers would be isolated from oxidation by the surrounding layers.

Although the energetic composition may be formed in various geometric shapes, it is contemplated that alternating disks of explosive and combustible fuel corresponding to the diameter of a projectile may be used, for example, as a propellant or a high energy payload.

Because many varying and different exemplary embodiments may be made with the scope of the inventive concepts taught herein, and because many modifications may be made in the exemplary embodiments detailed herein in accordance with the descriptive requirements of the law, it is to be understood that the detailed descriptions herein are to be interpreted as illustrative and not in a limiting sense.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed:

1. An energetic composition, comprising:
a first layer of a combustible fuel; and
a second layer of an explosive deposited on the first layer of the combustible fuel,
wherein the second layer is chemically bonded to the first layer by one of a vapor deposition and a sputter deposition process.

2. The energetic composition of claim 1, wherein the combustible fuel comprises a metal or metal alloy including at least one of aluminum, copper, iron, tungsten, hafnium, tantalum, magnesium, nickel, sodium, molybdenum, and potassium, or a non-metal including at least one of phosphorous and boron.

3. The energetic composition of claim 1, wherein the explosive comprises at least one of 1,3,5-trinitro-1,3,5-triazinane (RDX), 1,3,5,7-tetranitroperhydro-1,3,5,7-tetrazocine (HMX), 2,4,6,8,10,12-hexanitro-2,4,6,8,10,12-hexaazaisowurtzitane (CL-20), 2-methyl-1,3,5-trinitrobenzene (TNT), 2,4,6-trinitrophenyl-N-methlynitramine (Tetryl), 1,3,5-trinitro-2-[2-(2,4,6-trinitrophenyl)ethenyl]benzene (HNS), 3-nitro-1,2,4-triazol-5-one (NTO), 1,3,3-trinitroazetidine (TNAZ), nitroguanidine (NQ), 1,3-dinnitrato-2,2-bis(nitratomethyl)propane (PETN), ammonium dinitramide (AND), 1,3,5-triamino-2,4,6-trinitrobenzene (TATB), ammonium nitrate, and ammonium perchlorate.

4. The energetic composition of claim 1, wherein the second layer of the explosive has a thickness of about 1 nm.

5. An energetic composition comprising:
a first layer of an explosive; and
a second layer of a combustible fuel deposited on the first layer of the explosive, wherein the second layer is chemically bonded to the first layer by one of a vapor deposition and a sputter deposition process.

6. The energetic composition of claim 5, wherein the explosive comprises at least one of 1,3,5-trinitro-1,3,5-triazinane (RDX), 1,3,5,7-tetranitroperhydro-1,3,5,7-tetrazocine (HMX), 2,4,6,8,10,12-hexanitro-2,4,6,8,10,12-hexaazaisowurtzitane (CL-20), 2-methyl-1,3,5-trinitrobenzene (TNT), 2,4,6-trinitrophenyl-N-methlynitramine (Tetryl), 1,3,5-trinitro-2-[2-(2,4,6-trinitrophenyl)ethenyl]benzene (HNS), 3-nitro-1,2,4-triazol-5-one (NTO), 1,3,3-trinitroazetidine (TNAZ), nitroguanidine (NQ), 1,3-dinnitrato-2,2-bis(nitratomethyl)propane (PETN), ammonium dinitramide (AND), 1,3,5-triamino-2,4,6-trinitrobenzene (TATB), ammonium nitrate, and ammonium perchlorate.

7. The energetic composition of claim 5, wherein the combustible fuel comprises a metal or metal alloy including at least one of aluminum, copper, iron, tungsten, hafnium, tantalum, magnesium, nickel, sodium, molybdenum, and potassium, or a non-metal including at least one of phosphorous and boron.

8. The energetic composition of claim 5, wherein the second layer of the combustible fuel has a thickness of about 1 nm.

9. An energetic composition comprising:
a first layer of a combustible fuel;
a second layer of an explosive deposited on the first layer of the combustible fuel; and
a third layer of the combustible fuel deposited on the second layer of the explosive,
wherein the second layer is chemically bonded to the first layer by one of a vapor deposition and a sputter deposition process.

10. The energetic composition of claim 9, wherein the combustible fuel comprises a metal or metal alloy including at least one of aluminum, copper, iron, tungsten, hafnium, tantalum, magnesium, nickel, sodium, molybdenum, and potassium, or a non-metal including at least one of phosphorous and boron.

11. The energetic composition of claim 9, wherein the explosive comprises at least one of 1,3,5-trinitro-1,3,5-triazinane (RDX), 1,3,5,7-tetranitroperhydro-1,3,5,7-tetrazocine (HMX), 2,4,6,8,10,12-hexanitro-2,4,6,8,10,12-hexaazaisowurtzitane (CL-20), 2-methyl-1,3,5-trinitrobenzene (TNT), 2,4,6-trinitrophenyl-N-methlynitramine (Tetryl), 1,3,5-trinitro-2-[2-(2,4,6-trinitrophenyl)ethenyl]benzene (HNS), 3-nitro-1,2,4-triazol-5-one (NTO), trinitroazetidine (TNAZ), nitroguanidine (NQ), 1,3-dinnitrato-2,2-bis(nitratomethyl)propane (PSTN), ammonium dinitramide (AND), 1,3,5-triamino-2,4,6-trinitrobenzene (TATB), ammonium nitrate, and ammonium perchlorate.

12. The energetic composition of claim 9, wherein the third layer of the combustible fuel has a thickness of about 1 nm.

13. An energetic composition comprising:

a first layer of an explosive; and a second layer of a combustible fuel deposited on the first layer of the explosive; and a third layer of the explosive deposited on the second layer of the combustible wherein the second layer is chemically bonded to the first layer by one of a vapor deposition and a sputter deposition process.

14. The energetic composition of claim 13, wherein the explosive comprises at least one of 1,3,5-trinitro-1,3,5-triazinane (RDX), 1,3,5,7-tetranitroperhydro-1,3,5,7-tetrazocine (HMX), 2,4,6,8,10,12-hexanitro-2,4,6,8,10,12-hexaazaisowurtzitane (CL-20), 2-methyl-1,3,5-trinitrobenzene (TNT), 2,4,6-trinitrophenyl-N-methlynitramine (Tetryl), 1,3,5-trinitro-2-[2-(2,4,6-trinitrophenyl)ethenyl]benzene (HNS), 3-nitro-1,2,4-triazol-5-one (NTO), 1,3,3-trinitroazetidine (TNAZ), nitroguanidine (NQ), 1,3-dinnitrato-2,2-bis(nitratomethyl)propane (PETN), ammonium dinitramide (AND), 1,3,5-triamino-2,4,6-trinitrobenzene (TATB), ammonium nitrate, and ammonium perchlorate.

15. The energetic composition of claim 13, wherein the combustible fuel comprises a metal or metal alloy including at least one of aluminum, copper, iron, tungsten, hafnium, tantalum, magnesium, nickel, sodium, molybdenum, and potassium, or a non-metal including at least one of phosphorous and boron.

16. The energetic composition of claim 13, wherein the third layer of the explosive has a thickness of about 1 nm.

* * * * *